US007414532B2

(12) United States Patent
Goehlert et al.

(10) Patent No.: US 7,414,532 B2
(45) Date of Patent: Aug. 19, 2008

(54) METHOD OF ATTACHING RFID TAGS TO SUBSTRATES

(75) Inventors: Ralph W. Goehlert, Erkrath (DE); Harald Hillert, Markkleeberg (DE)

(73) Assignee: Nordson Corporation, Westlake, OH (US)

( * ) Notice: Subject to any disclaimer, the term of this patent is extended or adjusted under 35 U.S.C. 154(b) by 183 days.

(21) Appl. No.: 11/279,328

(22) Filed: Apr. 11, 2006

(65) Prior Publication Data

US 2006/0238354 A1 Oct. 26, 2006

Related U.S. Application Data

(60) Provisional application No. 60/673,322, filed on Apr. 20, 2005.

(51) Int. Cl.
*G08B 13/14* (2006.01)

(52) U.S. Cl. ..... 340/572.1; 340/572.8; 222/1

(58) Field of Classification Search ... 340/572.1–572.9; 222/1, 504

See application file for complete search history.

(56) References Cited

U.S. PATENT DOCUMENTS

| | | | | |
|---|---|---|---|---|
| 1,790,271 | A | 1/1931 | Kouyoumjian | |
| 2,114,961 | A | 4/1938 | Gille | 137/189 |
| 2,491,905 | A | 12/1949 | Ray | 62/127 |
| 2,550,297 | A | 4/1951 | Ray | 137/139 |
| 2,680,217 | A | 6/1954 | Hussey | 317/198 |
| 2,850,685 | A | 9/1958 | Ray | 317/165 |
| 2,873,069 | A | 2/1959 | Matthews | 236/1 |
| 3,212,715 | A | 10/1965 | Cocks | 239/125 |
| 3,243,013 | A | 3/1966 | Molin et al. | 184/14 |
| 3,259,811 | A | 7/1966 | Dunn | 317/191 |
| 3,329,347 | A | 7/1967 | Montgomery | 239/583 |
| 3,380,629 | A | 4/1968 | Kontra et al. | 222/26 |
| 3,422,850 | A | 1/1969 | Caldwell | 137/625.65 |
| 3,485,417 | A | 12/1969 | Cocks | 222/146 |
| 3,531,080 | A | 9/1970 | Dillon | 251/129 |
| 3,704,833 | A | 12/1972 | Wheat | 239/585 |
| 3,732,893 | A | 5/1973 | Ziesche et al. | 137/625.65 |
| 3,833,015 | A | 9/1974 | Kneuer | 137/334 |
| 3,912,133 | A | 10/1975 | Helh | 222/496 |

(Continued)

FOREIGN PATENT DOCUMENTS

DE 3841474 A1 6/1990

(Continued)

OTHER PUBLICATIONS

Nordson Corporation, Application Report RFID-Radio Frequency Identification, undated, 1 pg.

(Continued)

*Primary Examiner*—Phung Nguyen
(74) *Attorney, Agent, or Firm*—Wood, Herron & Evans, L.L.P.

(57) ABSTRACT

A method of securing an RFID tag to a substrate with a noncontact adhesive dispenser, the RFID tag having an electronic chip and an antenna coupled with the electronic chip. The method includes spacing an adhesive discharge outlet of the dispenser from the RFID tag, discharging a plurality of discrete amounts of adhesive through the spaced adhesive discharge outlet and onto an area defined outside of the area occupied by the electronic chip, and securing the RFID tag to the substrate with the adhesive.

9 Claims, 1 Drawing Sheet

U.S. PATENT DOCUMENTS

| | | | | |
|---|---|---|---|---|
| 3,921,670 | A | 11/1975 | Clippard, Jr. et al. | 137/625.65 |
| 4,007,880 | A | 2/1977 | Hans et al. | 239/585 |
| 4,218,669 | A | 8/1980 | Hitchcock et al. | 335/258 |
| 4,295,631 | A | 10/1981 | Allen | 251/30 |
| 4,437,488 | A | 3/1984 | Taggart et al. | 137/334 |
| 4,453,652 | A | 6/1984 | Merkel et al. | 222/504 |
| 4,474,332 | A | 10/1984 | Kaska | 239/585 |
| 4,531,679 | A | 7/1985 | Pagdin | 239/585 |
| 4,962,871 | A | 10/1990 | Reeves | |
| 4,981,280 | A | 1/1991 | Brandenberg | 251/26 |
| 4,981,281 | A | 1/1991 | Brundage et al. | 251/30.02 |
| 5,005,803 | A | 4/1991 | Fritz et al. | 251/129.15 |
| 5,022,629 | A | 6/1991 | Tibbals, Jr. | 251/129.02 |
| 5,027,976 | A * | 7/1991 | Scholl et al. | 222/1 |
| 5,054,691 | A | 10/1991 | Huang et al. | 239/585 |
| 5,178,332 | A | 1/1993 | Tsukakoshi et al. | 239/552 |
| 5,192,936 | A | 3/1993 | Neff et al. | 335/281 |
| 5,335,825 | A | 8/1994 | Fort | |
| 5,375,738 | A | 12/1994 | Walsh et al. | 222/1 |
| 5,535,919 | A | 7/1996 | Ganzer et al. | 222/1 |
| 5,747,102 | A | 5/1998 | Smith et al. | |
| 5,769,328 | A | 6/1998 | Zdyb et al. | 239/585.4 |
| 5,772,106 | A | 6/1998 | Ayers et al. | |
| 5,794,825 | A | 8/1998 | Gordon et al. | 222/504 |
| 5,875,922 | A | 3/1999 | Chastine et al. | 222/1 |
| 6,253,957 | B1 | 7/2001 | Messerly et al. | |
| 6,265,977 | B1 | 7/2001 | Vega et al. | 340/572.7 |
| 6,305,583 | B1 | 10/2001 | Ward et al. | 222/504 |
| 6,318,599 | B2 | 11/2001 | Estelle et al. | 222/146.5 |
| 6,405,755 | B1 | 6/2002 | Doehla et al. | 137/613 |
| 6,460,731 | B2 * | 10/2002 | Estelle et al. | 222/1 |
| 6,533,240 | B1 | 3/2003 | Lotz | 251/129.15 |
| 7,296,706 | B2 * | 11/2007 | Raterman et al. | 222/1 |
| 7,296,707 | B2 * | 11/2007 | Raines et al. | 222/54 |
| 7,296,714 | B2 * | 11/2007 | Byerly | 222/504 |
| 2001/0030307 | A1 | 10/2001 | Bergstrom et al. | 251/129.15 |
| 2001/0052585 | A1 | 12/2001 | Righolt et al. | 251/129.18 |
| 2003/0008081 | A1 * | 1/2003 | Haase et al. | 427/558 |
| 2003/0047627 | A1 | 3/2003 | Stier et al. | 239/585.5 |
| 2003/0071148 | A1 | 4/2003 | Hohl | 239/585.1 |
| 2003/0205589 | A1 | 11/2003 | Righolt et al. | 222/504 |
| 2004/0041707 | A1 * | 3/2004 | Hull et al. | 340/568.1 |
| 2004/0195278 | A1 | 10/2004 | Leeuw | 222/504 |
| 2005/0230438 | A1 | 10/2005 | Saidman | 222/504 |
| 2005/0271806 | A1 | 12/2005 | Ganzer et al. | |
| 2005/0275539 | A1 | 12/2005 | Sakama et al. | 340/572.7 |
| 2006/0033624 | A1 | 2/2006 | Copeland et al. | 340/572.7 |
| 2007/0029036 | A1 | 2/2007 | Fort et al. | |
| 2008/0014344 | A1 | 1/2008 | Fort et al. | |

FOREIGN PATENT DOCUMENTS

| | | | |
|---|---|---|---|
| WO | 97/38798 | A1 | 10/1997 |

OTHER PUBLICATIONS

Nordson Corporation, Nordson(R) E-700 Electric Gun, Jun. 1990, pp. 7-09 to 7-11 (3pgs.).

Spraymation, Inc., Exclusive Electromatic Head, The dripless adhesive applicator with accuracy and speed unmatched by any other system, undated, 1 pg.

Members of th Staff of the Department of Electrical Engineering, Massachusetts Institute of Technology, Principles of Engineering Series, Magnetic Circuits and Transformers, Ch. III, Problems, 1994, 3 pgs.

U.S. Patent and Trademark Office, International Search Report and Written Opinion in PCT/US06/05585, Jun. 23, 2006.

* cited by examiner

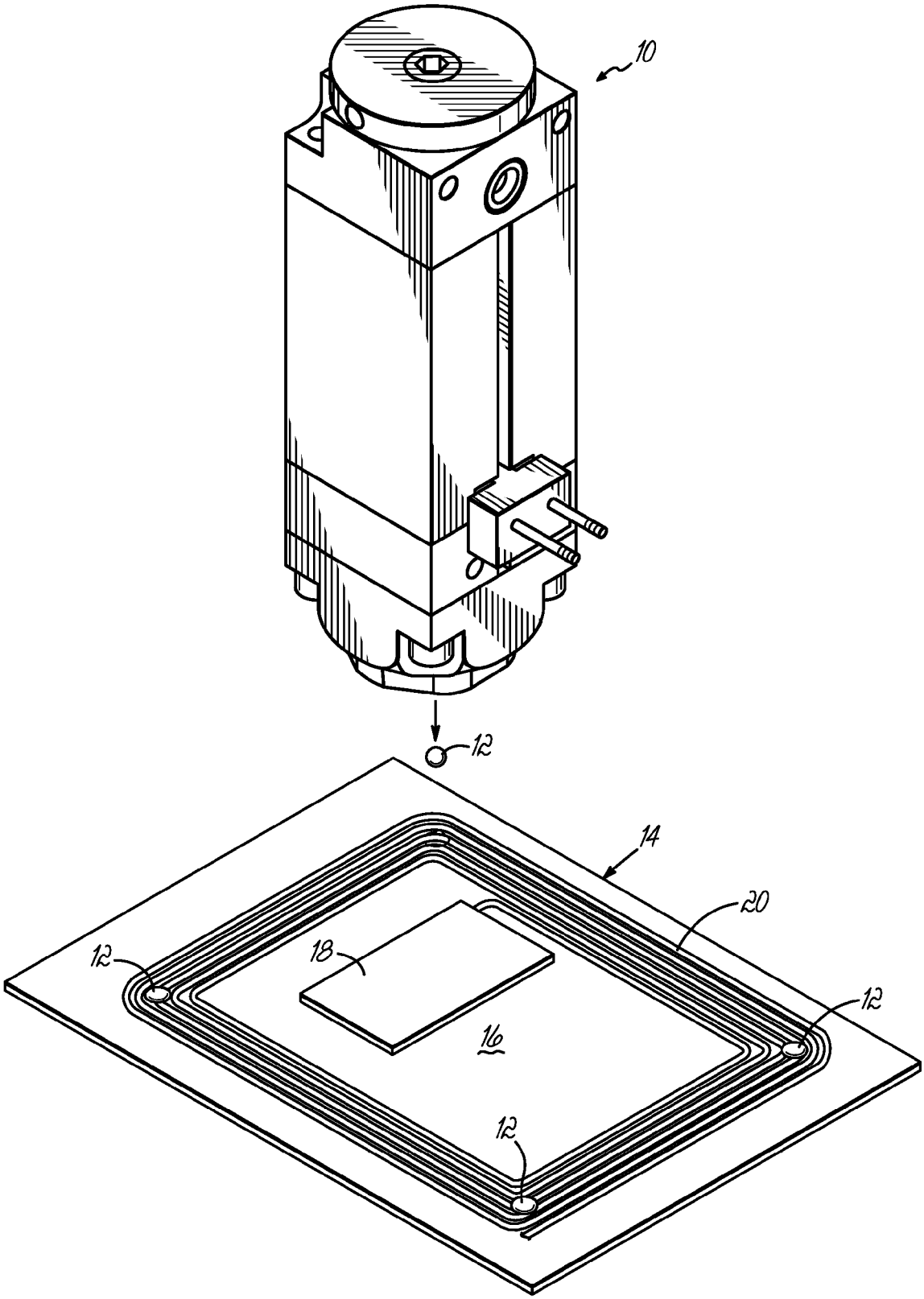
10
12
14
20
12
18
16
12
12

METHOD OF ATTACHING RFID TAGS TO SUBSTRATES

CROSS REFERENCE TO RELATED APPLICATIONS

This application claims the benefit of Provisional Ser. No. 60/673,322, filed Apr. 20, 2005, the disclosure of which is hereby fully incorporated herein by reference.

FIELD OF THE INVENTION

The present invention generally relates to affixing radio frequency identification (RFID) tags to substrates, such as on retail products and packaging, or any other substrate that may advantageously utilize the benefits of an RFID tag.

BACKGROUND OF THE INVENTION

RFID technology is attracting considerable attention as a complement to or even replacement for other identification methods, such as the use of barcodes. This is because RFID tags have significant range relative to a reading device and allow increased speed and unattended reading advantages. Various retailers and wholesalers now request that their vendors use RFID technology on the products that they supply in the future to allow fully automated, high speed and unattended reading of packages or products in the supply chain.

A typical RFID system includes a tag or label that is embedded with a single chip processor and an antenna. The tag is similar to barcode labels more commonly in use today, but has more capacity and ability to transmit information. These tags may be "read only" or read/write type tags. Read only tags are more like barcodes as the encoded data cannot be changed and is often only a serial number that is used to retrieve additional descriptive data, such as item type, date of manufacture, etc., from a database. Read/write tags function similar to computer disks because they can be rewritten and updated an unlimited number of times, and may offer "locked" sections that may not be altered. The RFID system further includes a radio enabling device that communicates with or interrogates the tag for purposes of reading and writing information from and/or to the chip.

Various types of tags and labels are currently available for use in different environmental conditions. Suppliers using read/write tags may comply with the new requirements of their customers at minimal cost for disruption by writing the new information to their existing pallets. Suppliers using read only tags would have to purchase new tags for each pallet, apply them and remove the old tags to ensure that the old tags would not be read by the retailer or wholesaler. In such situations, the RFID tags may be supplied on wheels or reels having siliconized carriers for the tags. Exchanging the RFID tags in this manner usually involves downtime due to manufacturing line stoppages. Also, disposal of the carriers creates additional cost due, for example, to environmental laws.

One current method of affixing RFID tags onto substrates is to apply pressure sensitive adhesive onto the RFID tag and temporarily bond these tags onto a carrier material which is stored on a reel as mentioned above. In this instance, however, the RFID tags must be highly flexible such that they may be carried on the reel without damage or debonding. Other RFID tags will lose their function when bent and, therefore, must be stacked in magazines before being affixed to a substrate.

SUMMARY OF THE INVENTION

The present invention generally relates to a method of securing an RFID tag to a substrate using a noncontact adhesive dispenser. The method comprises spacing an adhesive discharge outlet of the dispenser from the RFID tag having an electronic chip and an antenna coupled with the electronic chip. A plurality of discrete amounts of adhesive are discharged through the spaced adhesive discharge outlet and onto an area defined outside of the area occupied by the electronic chip. The plurality of discrete amounts of adhesive may take on various forms, such as dots or discrete beads of adhesive jetted onto the area defined outside of the area occupied by the electronic chip. The area defined outside of the electronic chip is preferably an area occupied by the antenna. It will be understood that in most if not all cases, the chip and the antenna will be encased or covered with a suitable protective material and, therefore, when the adhesive is applied to the area occupied by the antenna, for example, it will typically not be applied directly to the antenna itself but rather on the material covering or otherwise protecting the antenna.

The method of this invention allows the use of high speed automatic adhesive dispensing guns for intermittently dispensing discrete amounts of adhesive, such as small dots of hot melt adhesive. A pattern of small dots of hot melt adhesive may be applied in a noncontact manner onto the RFID tag, as described, immediately prior to placement of the tag on the substrate. As the dots are placed around, but not on the electronic chip, the high temperature of the hot melt adhesive will not adversely affect the electronic chip. The high speed intermittent operation of the adhesive dispensing gun allows for an efficient, low cost manufacturing or packaging method. The method may be used on various types of RFID tags, but is especially advantageous for those tags that must not be bent and are, for example, dispensed from a stacked condition in a magazine. In this situation, the dispensing operation may take place immediately after dispensing the RFID tag from the magazine and immediately prior to application of the tag onto the substrate.

BRIEF DESCRIPTION OF THE DRAWING

The drawing FIGURE is a perspective view of an intermittent, noncontact hot melt adhesive dispenser discharging a plurality of discrete amounts of adhesive onto an antenna area of an RFID tag.

DETAILED DESCRIPTION

The FIGURE illustrates an electrically operated dispensing module 10 that is more specifically disclosed in published U.S. Patent Application No. 2004/0195278, published on Oct. 7, 2004, and assigned to the assignee of the present invention. The disclosure of U.S. Patent Publication No. 2004/0195278 is hereby incorporated in its entirety by reference herein. As fully disclosed in the above incorporated patent application, the dispenser 10 is capable of high speed intermittent application of discrete amounts of hot melt adhesive 12. For example, the adhesive may be dispensed in various forms such as dots, as shown, or other forms such as discrete elongated beads of adhesive. The RFID tag 14 shown in the FIGURE will typically include a support member 16 carrying an electronic chip 18 coupled with an antenna 20. The discrete amounts of adhesive 12 are applied at various described locations outside the area occupied by the electronic chip 18. In the preferred embodiment, these discrete amounts of adhesive 12 are applied to the area occupied by the antenna 20. This allows high speed, effective bonding through the use of hot melt materials without damaging the chip 18 or impairing its ability to function. While dots of hot melt adhesive 12 are illustrated as being dispensed essentially onto the four corners of a generally rectangular shaped configuration of antenna 20, it will be appreciated that different discrete amounts of adhesive 12 may be applied depending on the needs of the application and that the adhesive 12 may be dispensed additionally or alternatively to other areas of the RFID tag 14 that are outside the area occupied by the electronic chip 18.

The RFID tag 14 is preferably of the type that should not be bent and which is therefore typically supplied in a magazine (not shown) with an additional supply of similar RFID tags for use during product assembly and/or packaging. Therefore, the method preferably involves moving the RFID tag 14 out of the magazine, applying the discrete amounts of hot melt adhesive 12 from the noncontact dispenser 10, for example, as schematically shown in the FIGURE, and then applying the RFID tag 14 to the substrate, such as a product or product packaging (not shown), using the applied adhesive to securely fasten the RFID tag 14 to the substrate.

While the present invention has been illustrated by a description of a preferred embodiment and while this embodiment has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims.

What is claimed is:

1. A method of securing an RFID tag to a substrate with a noncontact adhesive dispenser, the RFID tag having an electronic chip and an antenna coupled with the electronic chip, and the method comprising:

spacing an adhesive discharge outlet of the dispenser from the RFID tag, discharging a plurality of discrete amounts of adhesive through the spaced adhesive discharge outlet and onto an area defined outside of the area occupied by the electronic chip, and securing the RFID tag to the substrate with the adhesive immediately after discharging the discrete amounts of adhesive.

2. The method of claim 1, wherein discharging the plurality of discrete amounts of adhesive further comprises applying the discrete amounts of adhesive to an area occupied by the antenna.

3. The method of claim 1, wherein the plurality of discrete amounts of adhesive further comprise discrete dots of adhesive jetted onto the area defined outside of the area occupied by the electronic chip.

4. The method of claim 1, wherein the adhesive is a hot melt adhesive.

5. A method of securing an RFID tag to a substrate with a noncontact adhesive dispenser, the RFID tag being supplied in a magazine and having an electronic chip and an antenna coupled with the electronic chip, and the method comprising:

moving the RFID tag out of the magazine;

spacing an adhesive discharge outlet of the dispenser from the RFID tag, discharging a plurality of discrete amounts of adhesive through the spaced adhesive discharge outlet after the RFID tag is moved out of the magazine, wherein the discrete amounts of adhesive are applied onto an area defined outside of the area occupied by the electronic chip, and securing the RFID tag to the substrate with the adhesive.

6. The method of claim 5, wherein discharging the plurality of discrete amounts of adhesive further comprises applying the discrete amounts of adhesive to an area occupied by the antenna.

7. The method of claim 5, wherein the plurality of discrete amounts of adhesive further comprise discrete dots of adhesive jetted onto the area defined outside of the area occupied by the electronic chip.

8. The method of claim 5, wherein the adhesive is a hot melt adhesive.

9. A method of securing an RFID tag to a substrate with a noncontact adhesive dispenser, the RFID tag having an electronic chip and an antenna coupled with the electronic chip, and the method comprising:

spacing an adhesive discharge outlet of the dispenser from the RFID tag, discharging a plurality of discrete amounts of adhesive through the spaced adhesive discharge outlet and onto an area occupied by the antenna and defined outside of the area occupied by the electronic chip, and securing the RFID tag to the substrate with the adhesive.

* * * * *